US007934488B2

(12) United States Patent
Biasci et al.

(10) Patent No.: US 7,934,488 B2
(45) Date of Patent: May 3, 2011

(54) COUPLING DEVICE

(75) Inventors: Enio Biasci, Campo (IT); Edoardo Giorgetti, Rosignano Manttino (IT); Massimo Latini, Empoli (IT); Daniel Marc, Leghorn (IT)

(73) Assignee: Continental Automotive GmbH, Hannover (DE)

( * ) Notice: Subject to any disclaimer, the term of this patent is extended or adjusted under 35 U.S.C. 154(b) by 285 days.

(21) Appl. No.: 12/371,689

(22) Filed: Feb. 16, 2009

(65) Prior Publication Data

US 2010/0071668 A1 Mar. 25, 2010

(30) Foreign Application Priority Data

Feb. 19, 2008 (EP) ..... 08003046

(51) Int. Cl.
*F02M 61/14* (2006.01)

(52) U.S. Cl. ..... 123/470

(58) Field of Classification Search ..... 123/456, 123/468, 469, 470; 285/19, 30, 67, 365, 285/407, 408, 413
See application file for complete search history.

(56) References Cited

U.S. PATENT DOCUMENTS

| | | | | |
|---|---|---|---|---|
| 749,496 | A * | 1/1904 | Patterson et al. | 285/67 |
| 2,950,130 | A * | 8/1960 | Schneider | 285/67 |
| 3,260,539 | A * | 7/1966 | Herron | 285/24 |
| 3,908,621 | A | 9/1975 | Hussey | 123/139 |
| 4,143,625 | A | 3/1979 | Kulke | 123/32 |
| 4,213,564 | A | 7/1980 | Hulsing | 239/88 |
| 4,295,452 | A | 10/1981 | Lembke et al. | 123/470 |
| 5,765,534 | A | 6/1998 | Brown et al. | 123/470 |
| 5,943,995 | A | 8/1999 | Niwa et al. | 123/470 |
| 6,176,221 | B1 | 1/2001 | Hofmann | 123/470 |
| 6,237,571 | B1 | 5/2001 | Harrison | 123/469 |
| 6,431,151 | B1 * | 8/2002 | Gmelin | 123/470 |
| 6,499,468 | B1 | 12/2002 | Ferraro et al. | 123/470 |
| 6,543,421 | B2 | 4/2003 | Lorraine et al. | 123/470 |
| 6,745,753 | B2 | 6/2004 | Spinnler et al. | 123/509 |
| 6,830,036 | B2 * | 12/2004 | Okajima et al. | 123/470 |
| 6,860,008 | B2 | 3/2005 | Bodenhausen et al. | 29/855 |

(Continued)

FOREIGN PATENT DOCUMENTS

DE 19941770 3/2001

(Continued)

OTHER PUBLICATIONS

Extended European Search Report and Written Opinion for Application No. 09000673.5 (6 pages).

*Primary Examiner* — Thomas N Moulis
(74) *Attorney, Agent, or Firm* — King & Spalding L.L.P.

(57) ABSTRACT

Coupling device for hydraulically and mechanically coupling a fuel injector to a fuel rail of a combustion engine, the coupling device having a fuel injector cup having a central longitudinal axis and being designed to be hydraulically coupled to the rail and to engage a fuel inlet portion of the injector, a first ring element being fixedly coupled to the cup, a second ring element being fixedly coupled to the injector, and a shell element with a first and second shell part. The first shell part is fixedly coupled to the second shell part. The first and second ring elements are axially arranged between the first and second shell part. The shell element is designed and arranged in a way that the first and second ring element are in engagement with the shell element to retain the injector in the cup in direction of the central longitudinal axis.

20 Claims, 4 Drawing Sheets

U.S. PATENT DOCUMENTS

| | | | | |
|---|---|---|---|---|
| 6,877,484 | B2 | 4/2005 | Reiter | 123/468 |
| 6,923,162 | B2 | 8/2005 | Reiter | 123/490 |
| 7,063,075 | B2 | 6/2006 | Berger et al. | |
| 7,195,003 | B2 * | 3/2007 | Liskow | 123/470 |
| 7,334,571 | B1 | 2/2008 | Beardmore | 123/470 |
| 7,445,252 | B2 * | 11/2008 | Ho | 285/409 |
| 7,516,735 | B1 | 4/2009 | Doherty et al. | 123/468 |
| 7,591,489 | B2 * | 9/2009 | Woo | 285/365 |
| 7,828,338 | B2 * | 11/2010 | Kertesz et al. | 285/365 |
| 2002/0100456 | A1 | 8/2002 | Panasuk et al. | |
| 2005/0066941 | A1 | 3/2005 | Berger et al. | |
| 2008/0042434 | A1 | 2/2008 | Kenny | 285/354 |
| 2008/0169364 | A1 | 7/2008 | Zdroik et al. | 239/533.2 |
| 2009/0229575 | A1 * | 9/2009 | Giorgetti et al. | 123/470 |
| 2009/0229576 | A1 * | 9/2009 | Biasci et al. | 123/470 |
| 2010/0012093 | A1 * | 1/2010 | Pepperine et al. | 123/470 |
| 2010/0018502 | A1 * | 1/2010 | Fischetti et al. | 123/470 |
| 2010/0192913 | A1 * | 8/2010 | Keidel et al. | 123/470 |

FOREIGN PATENT DOCUMENTS

| | | | |
|---|---|---|---|
| DE | 10108203 | A1 | 8/2002 |
| DE | 102004037117 | | 3/2006 |
| DE | 102005020380 | | 11/2006 |
| DE | 102005024044 | | 11/2006 |
| DE | 102006042597 | | 3/2008 |
| EP | 1255038 | A2 | 11/2002 |
| EP | 1279825 | | 1/2003 |
| EP | 1460264 | | 9/2004 |
| EP | 1818535 | | 8/2007 |
| FR | 2637021 | | 3/1990 |
| FR | 2872252 | | 12/2005 |
| GB | 2024937 | | 1/1980 |
| JP | 1096464 | | 4/1989 |
| WO | 0118384 | | 3/2001 |
| WO | WO 03038267 | A1 | 5/2003 |
| WO | 03046370 | | 6/2003 |

* cited by examiner

FIG 3
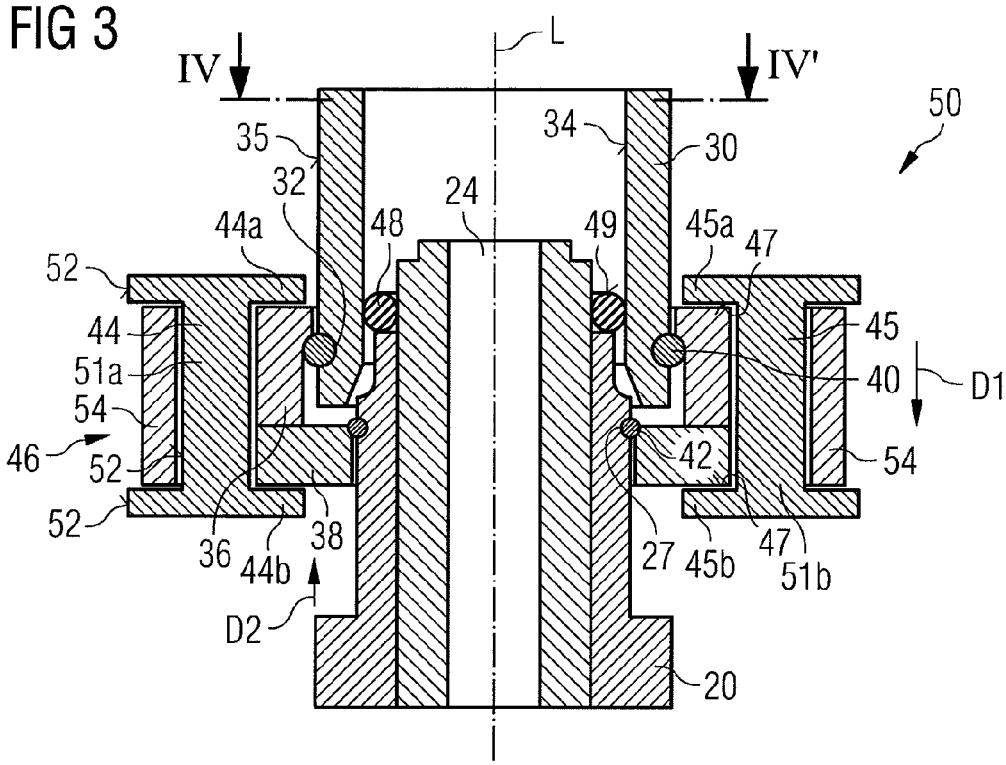
FIG 4 IV-IV'
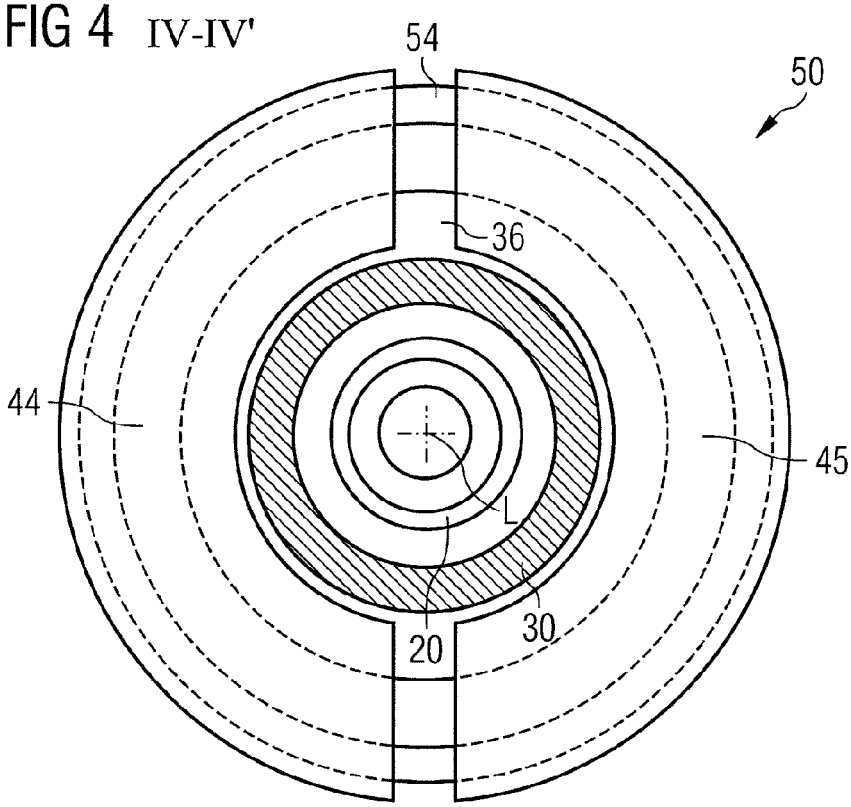

COUPLING DEVICE

CROSS-REFERENCE TO RELATED APPLICATIONS

This application claims priority to EP Patent Application No. 08003046 filed Feb. 19, 2008, the contents of which is incorporated herein by reference in its entirety.

TECHNICAL FIELD

The invention relates to a coupling device for hydraulically and mechanically coupling a fuel injector to a fuel rail of a combustion engine.

BACKGROUND

Coupling devices for hydraulically and mechanically coupling a fuel injector to a fuel rail are in widespread use, in particular for internal combustion engines. Fuel can be supplied to an internal combustion engine by the fuel rail assembly through the fuel injector. The fuel injectors can be coupled to the fuel injector cups in different manners.

In order to keep pressure fluctuations during the operation of the internal combustion engine at a very low level, internal combustion engines are supplied with a fuel accumulator to which the fuel injectors are connected and which has a relatively large volume. Such a fuel accumulator is often referred to as a common rail.

Known fuel rails comprise a hollow body with recesses in form of fuel injector cups, wherein the fuel injectors are arranged. The connection of the fuel injectors to the fuel injector cups that supply the fuel from a fuel tank via a low or high-pressure fuel pump needs to be very precise to get a correct injection angle and a sealing of the fuel.

SUMMARY

According to various embodiments, a coupling device for hydraulically and mechanically coupling a fuel injector to a fuel rail can be designed which is simply to be manufactured and which facilitates a reliable and precise connection between the fuel injector and the fuel injector cup without a resting of the fuel injector on the cylinder head.

According to an embodiment, a coupling device for hydraulically and mechanically coupling a fuel injector to a fuel rail of a combustion engine, may comprise:—a fuel injector cup having a central longitudinal axis and being designed to be hydraulically coupled to the fuel rail and to engage a fuel inlet portion of the fuel injector,—a first ring element being fixedly coupled to the fuel injector cup,—a second ring element being fixedly coupled to the fuel injector, and—a shell element with a first shell part and a second shell part, the first shell part being fixedly coupled to the second shell part, the first ring element and the second ring element being axially arranged between the first shell part and the second shell part, and the shell element being designed and arranged in a way that the first ring element and the second ring element are in engagement with the shell element to retain the fuel injector in the fuel injector cup in direction of the central longitudinal axis.

According to a further embodiment, the coupling device may comprise at least two shell elements. According to a further embodiment, the first ring element and the second ring element may comprise a cylindrical shape, and the shell parts may comprise planar surfaces facing the ring elements. According to a further embodiment, a fixing element may be arranged on a circumferential outer surface of the shell element and may be designed to prevent a movement of the shell element relative to the ring elements in a radial direction relative to the direction of the central longitudinal axis. According to a further embodiment, the shell element may comprise a groove, the fixing element may be at least partially arranged in the groove and may be designed to fixedly couple the shell element to the ring elements. According to a further embodiment, the fixing element may have a tubular shape. According to a further embodiment, the fixing element can be designed to enable an elastic expansion of the fixing element in radial direction. According to a further embodiment, the fuel injector cup may comprise a groove, a first snap ring may be arranged in the groove and may be designed to fixedly couple the first ring element to the fuel injector cup. According to a further embodiment, the groove and the first snap ring can be arranged and designed to form a positive fitting coupling between the first ring element and the fuel injector cup which is designed to prevent a movement of the first ring element relative to the fuel injector cup at least in a first direction of the central longitudinal axis. According to a further embodiment, a welding seam can be arranged between the first ring element and the fuel injector cup to fixedly couple the first ring element to the fuel injector cup. According to a further embodiment, the first ring element can be in one part with the fuel injector cup. According to a further embodiment, the fuel injector may comprise a groove, a second snap ring can be arranged in the groove of the fuel injector and may be designed to fixedly couple the second ring element to the fuel injector. According to a further embodiment, the groove of the fuel injector and the second snap ring can be arranged and designed to form a positive fitting coupling between the second ring element and the fuel injector which is designed to prevent a movement of the second ring element relative to the fuel injector at least in a second direction of the central longitudinal axis opposing the first direction of the central longitudinal axis. According to a further embodiment, a welding seam can be arranged between the second ring element and the fuel injector to fixedly couple the second ring element to the fuel injector. According to a further embodiment, the second ring element can be in one part with the fuel injector.

BRIEF DESCRIPTION OF THE DRAWINGS

Embodiments are explained in the following with the aid of schematic drawings. These are as follows:

FIG. 3 a longitudinal section through a first embodiment of a coupling device, FIG. 4 the coupling device along the line IV-IV' of FIG. 3 in a top view, partially in a section view, FIG. 5 a longitudinal section through a second embodiment of the coupling device, and FIG. 6 a longitudinal section through a third embodiment of the coupling device.

Elements of the same design and function that occur in different illustrations are identified by the same reference character.

DETAILED DESCRIPTION

Figure 1:
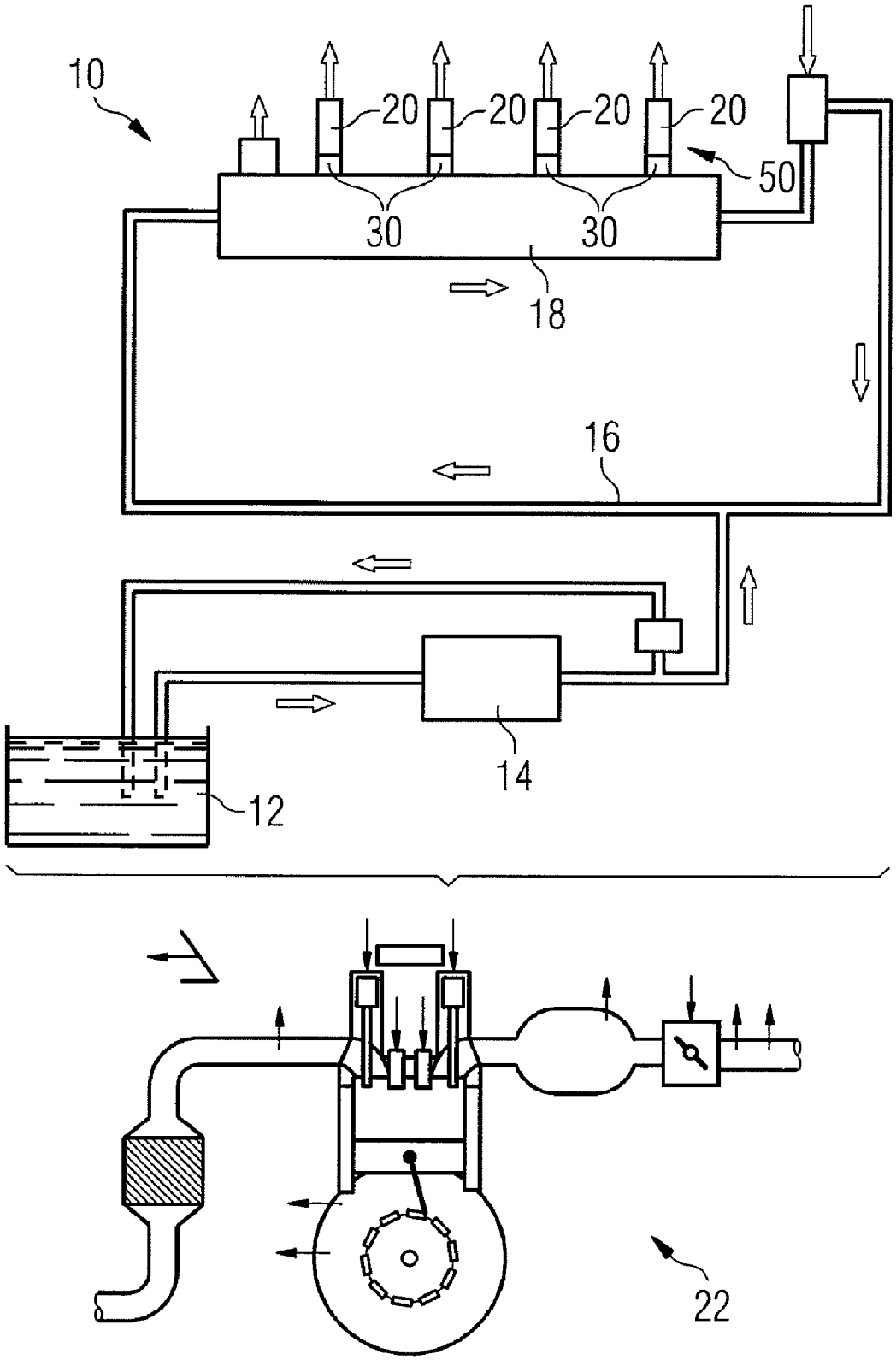
FIG. 1 an internal combustion engine in a schematic view.

The various embodiments are distinguished by a coupling device for hydraulically and mechanically coupling a fuel injector to a fuel rail of a combustion engine, the coupling device comprising a fuel injector cup having a central longitudinal axis and being designed to be hydraulically coupled to the fuel rail and to engage a fuel inlet portion of the fuel injector, a first ring element being fixedly coupled to the fuel injector cup, and a shell element with a first shell part and a second shell part. The first shell part is fixedly coupled to the second shell part. The first ring element and the second ring element are axially arranged between the first shell part and the second shell part. The shell element is designed and arranged in a way that the first ring element and the second ring element are in engagement with the shell element to retain the fuel injector in the fuel injector cup in direction of the central longitudinal axis.

This has the advantage that a fast and secure coupling of the fuel injector in the fuel injector cup is possible. The coupling device can resist the high fuel pressures in the fuel injector and the fuel injector cup. Furthermore, the coupling of the fuel injector with the fuel rail by the ring elements of the fuel injector and the fuel injector cup allows an assembly of the fuel injector and the fuel rail without a further metallic contact between the fuel injector and further parts of the combustion engine. Consequently, a noise transmission between the fuel injector and further parts of the combustion engine can be kept small.

In an embodiment the coupling device comprises at least two shell elements. By this, a simple mounting and demounting of the shell elements to or from the ring elements is possible. Consequently, a simple mounting and demounting of the fuel injector to or from the fuel injector cup can be carried out. Furthermore, an axial symmetric arrangement of the shell elements is possible. Consequently, an axially symmetrical distribution of forces in the coupling device is possible.

In a further embodiment the first ring element and the second ring element have a cylindrical shape, and the shell parts have planar surfaces facing the ring elements. By this, a positive fitting coupling between the ring elements and the shell elements is possible to prevent a movement of the ring elements relative to each other in axial direction.

In a further embodiment a fixing element is arranged on a circumferential outer surface of the shell element and is designed to prevent a movement of the shell element relative to the ring elements in a radial direction relative to the direction of the central longitudinal axis.

This is a simple possibility to ensure a secure coupling between the ring elements and the shell elements.

In a further embodiment the shell element comprises a groove, the fixing element is at least partially arranged in the groove and is designed to fixedly couple the shell element to the ring elements. This has the advantage that a secure arrangement of the fixing element in the groove is possible to prevent a decoupling of the fixing element from the shell element.

In a further embodiment the fixing element has a tubular shape. By this, the fixing element can be easily arranged in the groove of the shell element, in particular if the groove has a rectangular square section. Furthermore, the fixing element can enable a secure coupling between the ring elements and the shell elements.

In a further embodiment the fixing element is designed to enable an elastic expansion of the fixing element in radial direction. This has the advantage that the fixing element can be easily removed from the shell element for a simple mounting and demounting of the fuel injector to or from the fuel injector cup.

In a further embodiment the fuel injector cup comprises a groove, and a first snap ring is arranged in the groove and is designed to fixedly couple the first ring element to the fuel injector cup. This may allow a simple construction of the coupling device which enables to carry out a fast and secure but reversible coupling of the first ring element to the fuel injector cup.

In a further embodiment the groove and the first snap ring are arranged and designed to form a positive fitting coupling between the first ring element and the fuel injector cup which is designed to prevent a movement of the first ring element relative to the fuel injector cup at least in a first direction of the central longitudinal axis. By this a secure coupling of the first ring element to the fuel injector cup is enabled.

In a further embodiment the coupling device has a welding seam which is arranged between the first ring element and the fuel injector cup to fixedly couple the first ring element to the fuel injector cup. This allows a simple construction of the coupling device and carrying out a very secure coupling of the fuel injector to the fuel injector cup.

In a further embodiment the first ring element is in one part with the fuel injector cup. This has the advantage that a very secure coupling of the fuel injector to the fuel injector cup is possible. Furthermore, a simple machining of the first ring element together with the fuel injector cup is possible.

In a further embodiment the fuel injector comprises a groove, a second snap ring is arranged in the groove of the fuel injector and is designed to fixedly couple the second ring element to the fuel injector. This may allow a simple construction of the coupling device which enables to carry out a fast and secure but reversible coupling of the second ring element to the fuel injector.

In a further embodiment the groove of the fuel injector and the second snap ring are arranged and designed to form a positive fitting coupling between the second ring element and the fuel injector which is designed to prevent a movement of the second ring element relative to the fuel injector at least in a second direction of the central longitudinal axis opposing the first direction of the central longitudinal. By this a secure coupling of the second ring element to the fuel injector is enabled.

In a further embodiment a welding seam is arranged between the second ring element and the fuel injector to fixedly couple the second ring element to the fuel injector. This allows a simple construction of the coupling device and carrying out a very secure coupling of the fuel injector to the fuel injector cup.

In a further embodiment the second ring element is in one part with the fuel injector. This has the advantage that a very secure coupling of the fuel injector to the fuel injector cup is possible. Furthermore, a simple machining of the second ring element together with the fuel injector is possible.

In a further embodiment the ring elements are designed and arranged to enable a screw coupling between the ring elements. This has the advantage that a simple construction of the coupling device is possible which allows carrying out a fast and secure coupling of the fuel injector in the fuel injector cup. Furthermore, a defined positioning of the fuel injector relative to the fuel injector cup in axial and circumferential direction is enabled.

A fuel feed device 10 is assigned to an internal combustion engine 22 (FIG. 1) which can be a diesel engine or a gasoline engine. It includes a fuel tank 12 that is connected via a first fuel line to a fuel pump 14. The output of the fuel pump 14 is connected to a fuel inlet 16 of a fuel rail 18. In the fuel rail 18, the fuel is stored for example under a pressure of about 200 bar in the case of a gasoline engine or of about 2,000 bar in the case of a diesel engine. Fuel injectors 20 are connected to the fuel rail 18 and the fuel is fed to the fuel injectors 20 via the fuel rail 18.

Figure 2:
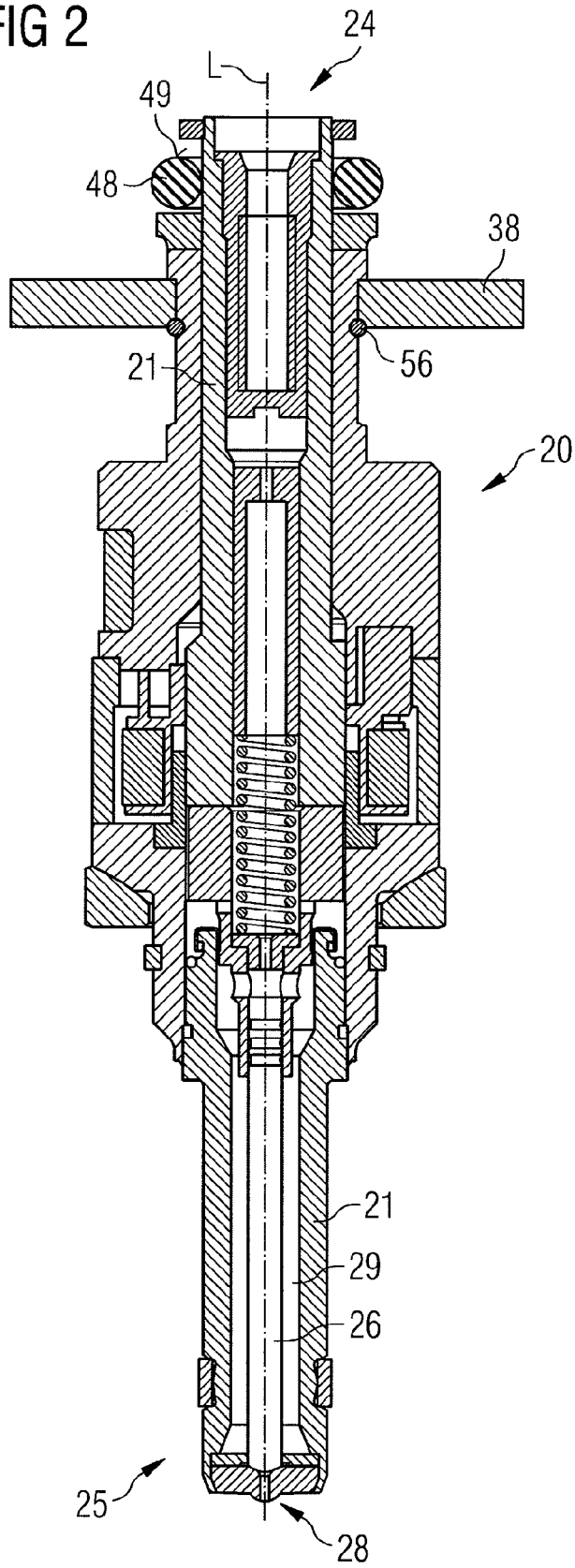
FIG. 2 a longitudinal section through a fuel injector.

FIG. 2 shows the fuel injector 20. The fuel injector 20 has a fuel injector body 21 and is suitable for injecting fuel into a combustion chamber of the internal combustion engine 22. The fuel injector 20 has a fuel inlet portion 24 and a fuel outlet portion 25.

Furthermore, the fuel injector 20 comprises a valve needle 26 taken in a cavity 29 of the fuel injector body 21. On a free end of the fuel injector 20 an injection nozzle 28 is formed which is closed or opened by an axial movement of the valve needle 26. In a closing position a fuel flow through the injection nozzle 28 is prevented. In an opening position fuel can flow through the injection nozzle 28 into the combustion chamber of the internal combustion engine 22.

FIGS. 3 to 6 show different embodiments of a coupling device 50 which is coupled to the fuel rail 18 of the internal combustion engine 22. The coupling device 50 has a fuel injector cup 30, a first ring element 36, a second ring element 38, two shell elements 44, 45 and a fixing element 54. In further embodiments the number of shell elements can be one or greater than two.

The fuel injector cup 30 has a central longitudinal axis L, comprises an inner surface 34 and an outer surface 35 and is hydraulically coupled to the fuel rail 18. Furthermore, the fuel injector cup 30 is in engagement with the fuel inlet portion 24 of the fuel injector 20. The fuel inlet portion 24 of the fuel injector 20 comprises a sealing ring 48 with an outer surface 49.

The first ring element 36 has a cylindrical shape and is fixedly coupled to the fuel injector cup 30.

The second ring element 38 has a cylindrical shape and is fixedly coupled to the fuel injector 20.

FIG. 3 shows an embodiment of the coupling device 50 wherein the fuel injector cup 30 has a groove 32 and the fuel injector 20 has a groove 27. The coupling device 50 has a first snap ring 40 which is arranged in the groove 32 of the fuel injector cup 30 and a second snap ring 42 which is arranged in the groove 27 of the fuel injector 20. The first ring element 36 is in engagement with the first snap ring 40 and the second ring element 38 is in engagement with the second snap ring 42.

The first snap ring 40 enables a positive fitting coupling between the first ring element 36 and the fuel injector cup 30 to prevent a movement of the first ring element 36 relative to the fuel injector cup 30 in a first direction D1. The second snap ring 42 enables a positive fitting coupling between the second ring element 38 and the fuel injector 20 to prevent a movement of the second ring element 38 relative to the fuel injector 20 in a second direction D2. The first direction D1 and the second direction D2 are opposing directions of the central longitudinal axis L.

The shell elements 44, 45 have substantially the form of half hollow cylinders. They are arranged in a way that together they are forming basically a complete cylinder (FIG. 4). At a first axial end the shell element 44 has a first shell part 44*a*. At a second axial end the shell element 44 has a second shell part 44*b*. The shell element 45 has respective shell parts 45*a*, 45*b* at opposing axial ends. The shell parts 44*a*, 44*b*, 45*a*, 45*b* have planar surfaces 47 which are facing the ring elements 36, 38. Each of the first shell parts 44*a*, 45*a* is fixedly coupled to one of the second shell parts 44*b*, 45*b* by respective half tube parts 51*a*, 51*b*. The half tube parts 51*a*, 51*b* of the shell elements 44, 45 have circumferential outer surfaces 52 and grooves 46. The circumferential outer surfaces 52 are partially arranged in the grooves 46.

The first ring element 36 and the second ring element 38 are axially arranged between the first shell parts 44*a*, 45*a* and the second shell parts 44*b*, 45*b*. Consequently, the first ring element 36 and the second ring element 38 are in engagement with the shell elements 44, 45 to prevent a movement of the ring elements 36, 38 in direction of the central longitudinal axis L. By this, the fuel injector 20 is fixedly coupled to the fuel injector cup 30 in direction of the central longitudinal axis L.

The fixing element 54 has a tubular shape and is arranged in the grooves 27 of the shell elements 44, 45 on the circumferential outer surfaces 52 of the shell elements 44, 45. The fixing element 54 can couple the shell elements 44, 45 fixedly to the ring elements 36, 38. Thereby a movement of the shell elements 44, 45 relative to the ring elements 36, 38 in a radial direction can be prevented. The fixing element 54 is elastically expandable in radial direction so that the fixing element 54 can be easily removed from the grooves 27 of the shell elements 44, 45. In further embodiments the shell elements 44, 45 can comprise snap elements by which the shell elements 44, 45 can be fixedly coupled to each other and, consequently, the shell elements 44, 45 can be fixedly coupled to the ring elements 36, 38.

As the first ring element 36 is fixedly coupled to the fuel injector cup 30, the second ring element 38 is fixedly coupled to the fuel injector 20 and the first ring element 36 is fixedly coupled to the second ring element 38 by the shell elements 44, 45 and the fixing element 54, the fuel injector 20 is retained in the fuel injector cup 30 in direction of the central longitudinal axis L.

In the following, the assembly and disassembly of the fuel injector 20 with the fuel injector cup 30 according to the embodiment of FIGS. 3 and 4 will be described:

For assembling, the first ring element 36 is shifted over the fuel injector cup 30, the first snap ring 40 is shifted into the groove 32 of the fuel injector cup 30, the second ring element 38 is shifted over the fuel injector 20 and the second snap ring 42 is shifted into the groove 27 of the fuel injector 20. Additionally, the first ring element 36 is shifted on the fuel injector cup 30 until it is in a positive fitting coupling with the fuel injector cup 30 to prevent a movement of the first ring element 36 relative to the fuel injector cup 30 in the first direction D1 of the central longitudinal axis L. Furthermore, the second ring element 38 is shifted over the fuel injector 20 until it is in a positive fitting coupling with the fuel injector 20 to prevent a movement of the second ring element 38 relative to the fuel injector 20 in the second direction D2 of the central longitudinal axis L opposing the first direction D1 of the central longitudinal axis L.

Furthermore, the fuel inlet portion 24 of the fuel injector 20 is shifted into the fuel injector cup 30 in a way that the first ring element 26 and the second ring element 38 are in engagement with each other. Then, the shell elements 44, 45 are shifted over the ring elements 36, 38 in radial direction towards the central longitudinal axis L and the fixing element 54 is arranged in the groove 46 of the shell elements 44, 45. By this the shell elements 44, 45 are fixed against a movement in radial direction relative to the ring elements 36, 38. Now a state as shown in FIG. 3 is obtained. As can be seen in FIG. 3, the inner surface 34 of the fuel injector cup 30 is in sealing engagement with the outer surface 49 of the sealing ring 48. After the assembly process fuel can flow through the fuel injector cup 30 into the fuel inlet portion 24 of the fuel injector 20 without fuel leakage.

To disassemble the fuel injector 20 from the fuel injector cup 30, the fixing element 54 is removed from the groove 46 of the shell elements 44, 45 and the shell elements 44, 45 are removed from the ring elements 36, 38. Then, the fuel injector 20 can be shifted away from the fuel injector cup 30 in axial direction and the fuel injector cup 30 and the fuel injector 20 can be separated from each other.

Figure 5:
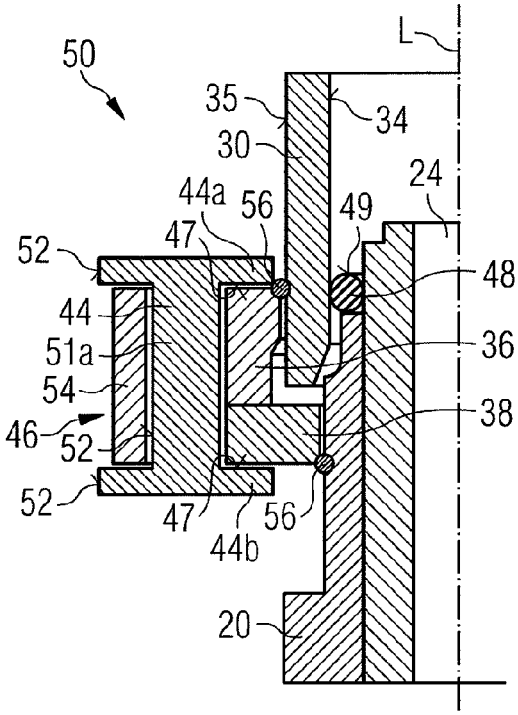

In the embodiment of FIG. 5 the coupling device 50 has welding seams 56 between the first ring element 36 and the fuel injector cup 30 and between the second ring element 38 and the fuel injector 20. The ring elements 36, 38 are rigidly coupled to the fuel injector cup 30 and the fuel injector 20 respectively by the welding seams 56.

In the following the assembly and disassembly of the fuel injector 20 with the fuel injector cup 30 of the embodiment of FIG. 5 will be described:

After the first ring element 36 has been shifted over the fuel injector cup 30 and the second ring element 38 has been shifted over the fuel injector 20 the welding seams 56 are attached to fixedly couple the first ring element 36 to the fuel injector cup 30 and the second ring element 38 to the fuel injector 20. The fuel inlet portion 24 of the fuel injector 20 is pushed into the fuel injector cup 30. Hence, the inner surface 34 of the fuel injector cup 30 is in sealing engagement with the outer surface 49 of the sealing ring 48. The shell elements 44, 45 are moved over the ring elements 36, 38 and fixed by the fixing element 54 as described in the embodiment of FIGS. 3 and 4.

The disassembly of the fuel injector 20 from the fuel injector cup 30 of the embodiment of the coupling device 50 of FIG. 5 is carried in the same manner as described for the embodiment of FIGS. 3 and 4.

Figure 6:
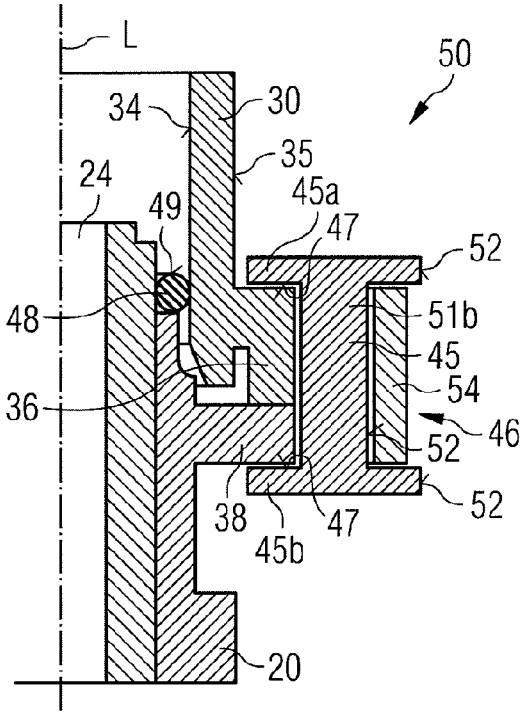

In the embodiment of the coupling device 50 of FIG. 6 the first ring element 36 is in one part with the fuel injector cup 30 and the second ring 38 is in one part with the fuel injector 20. By this a very rigid and very secure coupling between the fuel injector cup 30 and the fuel injector 20 is possible.

For assembling the fuel injector 20 with the fuel injector cup 30 according to the embodiment of FIG. 6, the fuel inlet portion 24 of the fuel injector 20 is shifted into the fuel injector cup 30 and the first ring element 36 and the second ring element 38 are coupled by the shell elements 44, 45 and the fixing element 54 as described in the embodiment of FIGS. 3 and 4.

The disassembly of the fuel injector 20 from the fuel injector cup 30 of the embodiment of the coupling device 50 of FIG. 6 is carried in the same manner as described for the embodiment of FIGS. 3 and 4.

The coupling of the fuel injector 20 with the fuel rail 18 by the ring elements 36, 38 and the shell elements 44, 45 allows an assembly of the fuel injector 20 and the fuel injector cup 30 without a further metallic contact between the fuel injector 20 and the further parts of the internal combustion engine 22. A sealing between the fuel injector body 21 and a combustion chamber of the internal combustion engine 22 can be carried out by a plastic element, in particular by a PTFE element. Consequently, noise transmission between the fuel injector 20 and further parts of the internal combustion engine can be kept small.

What is claimed is:

1. A coupling device for hydraulically and mechanically coupling a fuel injector to a fuel rail of a combustion engine, the coupling device comprising:

a fuel injector cup having a central longitudinal axis and being designed to be hydraulically coupled to the fuel rail and to engage a fuel inlet portion of the fuel injector, a first ring element being fixedly coupled to the fuel injector cup, a second ring element being fixedly coupled to the fuel injector, and a shell element with a first shell part and a second shell part, the first shell part being fixedly coupled to the second shell part, the first ring element and the second ring element being axially arranged between the first shell part and the second shell part, and the shell element being designed and arranged in a way that the first ring element and the second ring element are in engagement with the shell element to retain the fuel injector in the fuel injector cup in direction of the central longitudinal axis.

2. The coupling device according to claim 1, comprising at least two shell elements.

3. The coupling device according to claim 1, wherein the first ring element and the second ring element comprise a cylindrical shape, and the shell parts comprise planar surfaces facing the ring elements.

4. The coupling device according to claim 1, wherein a fixing element is arranged on a circumferential outer surface of the shell element and is designed to prevent a movement of the shell element relative to the ring elements in a radial direction relative to the direction of the central longitudinal axis.

5. The coupling device according to claim 4, wherein the shell element comprises a groove, the fixing element is at least partially arranged in the groove and is designed to fixedly couple the shell element to the ring elements.

6. The coupling device according to claim 5, wherein the fixing element has a tubular shape.

7. The coupling device according to claim 6, wherein the fixing element is designed to enable an elastic expansion of the fixing element in radial direction.

8. The coupling device according to claim 1, wherein the fuel injector cup comprises a groove, a first snap ring is arranged in the groove and is designed to fixedly couple the first ring element to the fuel injector cup.

9. The coupling device according to claim 8, wherein the groove and the first snap ring are arranged and designed to form a positive fitting coupling between the first ring element and the fuel injector cup which is designed to prevent a movement of the first ring element relative to the fuel injector cup at least in a first direction of the central longitudinal axis.

10. The coupling device according to claim 1, wherein a welding seam is arranged between the first ring element and the fuel injector cup to fixedly couple the first ring element to the fuel injector cup.

11. The coupling device according to claim 1, wherein the first ring element is in one part with the fuel injector cup.

12. The coupling device according to claim 1, wherein the fuel injector comprises a groove, a second snap ring is arranged in the groove of the fuel injector and is designed to fixedly couple the second ring element to the fuel injector.

13. The coupling device according to claim 11, wherein the groove of the fuel injector and the second snap ring are arranged and designed to form a positive fitting coupling between the second ring element and the fuel injector which is designed to prevent a movement of the second ring element relative to the fuel injector at least in a second direction of the central longitudinal axis opposing the first direction of the central longitudinal axis.

14. The coupling device according to claim 1, wherein a welding seam is arranged between the second ring element and the fuel injector to fixedly couple the second ring element to the fuel injector.

15. The coupling device according to claim 1, wherein the second ring element is in one part with the fuel injector.

16. A method for hydraulically and mechanically coupling a fuel injector to a fuel rail of a combustion engine, comprising the steps of:

designing a fuel injector cup having a central longitudinal axis to be hydraulically coupled to the fuel rail and to engage a fuel inlet portion of the fuel injector, fixedly coupling a first ring element to the fuel injector cup, fixedly coupling a second ring element to the fuel injector, and providing a shell element with a first shell part and a second shell part and fixedly coupling the first shell part to the second shell part, wherein the first ring element and the second ring element are axially arranged between the first shell part and the second shell part, and the shell element is designed and arranged in a way that the first ring element and the second ring element are in engagement with the shell element to retain the fuel injector in the fuel injector cup in direction of the central longitudinal axis.

17. The method according to claim 16, comprising the step of arranging and designing a fixing element on a circumferential outer surface of the shell element to prevent a movement of the shell element relative to the ring elements in a radial direction relative to the direction of the central longitudinal axis.

18. The method according to claim 17, wherein the shell element comprises a groove, the method comprising the step of at least partially arranging the fixing element in the groove to fixedly couple the shell element to the ring elements.

19. The method according to claim 1, wherein the fuel injector cup comprises a groove, the method comprising the step of arranging a first snap ring in the groove to fixedly couple the first ring element to the fuel injector cup.

20. The method according to claim 19, further comprising the step of arranging the groove and the first snap ring to form a positive fitting coupling between the first ring element and the fuel injector cup which is designed to prevent a movement of the first ring element relative to the fuel injector cup at least in a first direction of the central longitudinal axis.

* * * * *